US008371679B2

(12) United States Patent
Miyata et al.

(10) Patent No.: US 8,371,679 B2
(45) Date of Patent: Feb. 12, 2013

(54) LIQUID EJECTING HEAD UNIT AND LIQUID EJECTING APPARATUS

(75) Inventors: Yoshinao Miyata, Suwa (JP); Hiroshige Owaki, Suwa (JP); Kazutoshi Goto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 407 days.

(21) Appl. No.: 12/683,359

(22) Filed: Jan. 6, 2010

(65) Prior Publication Data

US 2010/0171794 A1 Jul. 8, 2010

(30) Foreign Application Priority Data

Jan. 8, 2009 (JP) ..... 2009-002960

(51) Int. Cl.
*B41J 2/14* (2006.01)
*B41J 2/16* (2006.01)

(52) U.S. Cl. ..... 347/50

(58) Field of Classification Search ..... 347/50
See application file for complete search history.

(56) References Cited

U.S. PATENT DOCUMENTS 6,206,507 B1 * 3/2001 Hino ..... 347/50
7,322,678 B2 1/2008 Suzuki
7,537,313 B2 5/2009 Miyata
2007/0273732 A1 11/2007 Owaki
2009/0201346 A1 8/2009 Miyata et al.
2010/0091071 A1 * 4/2010 Owaki ..... 347/50

FOREIGN PATENT DOCUMENTS

JP 2004-148813 A 5/2004
JP 2005-219337 A 8/2005
JP 2006-218840 A 8/2006
JP 2007-269012 A 10/2007
JP 2008-049715 A 3/2008
JP 2009-143002 A 7/2009
JP 2009-208462 A 9/2009
JP 2009-220461 A 10/2009

* cited by examiner

*Primary Examiner* — Matthew Luu
*Assistant Examiner* — Renee I Wilson
(74) *Attorney, Agent, or Firm* — Kilpatrick Townsend & Stockton LLP

(57) ABSTRACT

There is provided a liquid ejecting head unit that includes a liquid ejecting head ejecting liquid by driving a pressure generating element. The liquid ejecting head unit includes: the liquid ejecting head that includes first wiring substrates each having a connection wiring electrically connected to the pressure generating element and a support member that supports at least two first wiring substrates in different positions; a second wiring substrate that is commonly connected to the connection wirings of a plurality of the first wiring substrates electrically; and a head substrate to which the second wiring substrate is electrically connected. A connection portion connected to the head substrate is aligned on one face side of the second wiring substrate.

7 Claims, 11 Drawing Sheets

LIQUID EJECTING HEAD UNIT AND LIQUID EJECTING APPARATUS

BACKGROUND

This application claims priority to Japanese Patent Application No. 2009-002960, filed Jan. 8, 2009 the entirety of which is incorporated by reference herein.

1. Technical Field

The present invention relates to a liquid ejecting head unit and a liquid ejecting apparatus that include a liquid ejecting head that ejects liquid.

2. Related Art

As a representative example of a liquid ejecting head that discharges liquid droplets, there is an ink jet recording head that discharges ink droplets. As such an ink jet recording head, for example, an ink jet recording head that includes a flow path forming substrate, in which a pressure generating chamber communicated with a nozzle opening and a communication portion communicated with the pressure generating chamber are formed, a piezoelectric element that is formed on one face side of the flow path forming substrate, and a protection substrate that has a piezoelectric element holding portion that is bonded to a piezoelectric element side of the flow path forming substrate and is used for holding the piezoelectric element has been known. Here, on the protection substrate, an IC that is a driving circuit used for driving the piezoelectric element is placed. In addition, the driving circuit and the piezoelectric element are connected through a lead electrode, which is led out from one electrode of the piezoelectric element, with a connection wiring that is formed of a conductive wire by using a wire bonding method (for example, see JP-A-2004-148813).

In addition, an ink jet recording head unit including a case member in which an ink jet recording head is mounted and a second wiring substrate electrically connected to the ink jet recording head is held has been proposed (for example, see JP-A-2007-269012).

However, to connect a plurality of first wiring substrates, which is connected to an ink jet recording head, to a common second wiring substrate disposed in a case member is troublesome, and requires an additional process, whereby incurring high costs.

In addition, such a problem is not limited to an ink jet recording head unit that includes an ink jet recording head and exists also in a liquid ejecting head unit that ejects a liquid other than ink.

SUMMARY

An advantage of some aspects of the invention is that it provides a liquid ejecting head unit and a liquid ejecting apparatus of which manufacturing costs are reduced.

According to a first aspect of the invention, there is provided a liquid ejecting head unit that includes a liquid ejecting head ejecting liquid by driving a pressure generating element. The liquid ejecting head unit includes: the liquid ejecting head that includes first wiring substrates each having a connection wiring electrically connected to the pressure generating element and a support member that supports at least two first wiring substrates in different positions; a second wiring substrate that is commonly connected to the connection wirings of a plurality of the first wiring substrates electrically; and a head substrate to which the second wiring substrate is electrically connected. A terminal portion connected to the head substrate is aligned on one face side of the second wiring substrate.

According to the above-described liquid ejecting head unit, at least two first wiring substrates can be mounted together in the head substrate by one second wiring substrate. Accordingly, the costs can be reduced by decreasing the number of components. In addition, the costs can be reduced by decreasing the number of mounting processes.

In the above-described liquid ejecting head unit, a face of the first wiring substrate, in which the connection wiring connected to the second wiring is disposed, and a face of the second wiring substrate, in which the terminal portion connected to the head substrate is disposed, may be arranged so as to intersect each other. In such a case, the second wiring substrate connected to a plurality of the liquid ejecting heads can be disposed in a same face direction.

In addition, in the above-described liquid ejecting head unit, it may be configured that the liquid ejecting head is a plurality of liquid ejecting heads, and a plurality of the second wiring substrates is electrically connected to one face side of the common head substrate. In such a case, a plurality of the head substrates does not need to be arranged for the second wiring substrates. Accordingly, the number of components can be decreased, and connection spots between the head substrate and a control unit or the like can be decreased, whereby the costs can be reduced. In addition, the head substrate can be miniaturized, and accordingly, the head unit can be miniaturized.

In addition, in the above-described ejecting head unit, the second wiring substrate may be configured to include: a base portion in which the terminal portion connected to the head substrate is disposed; and at least two leg portions that are disposed to extend in a direction intersecting a face of the base portion in which the terminal portion of the base portion is disposed and are connected to the connection wiring of the first wiring substrate. In such a case, at least two second wiring substrates can be connected to the head substrate by one second wiring substrate.

In addition, in the above-described ejecting head unit, the second wiring substrate may be configured to include: a first wiring member that includes a first base portion in which the terminal portion connected to the head substrate is disposed, and a first leg portion that is connected to the first wiring substrate and is disposed in a direction intersecting a face of the first base portion in which the terminal portion is disposed; and a second wiring member that includes a second base portion in which the terminal portion connected to the head substrate is disposed and a second leg portion that is disposed to extend in a direction intersecting a face of the second base portion on which the terminal portion is disposed by connecting the support member to a second first wiring substrate disposed in a different position. In such a case, the first base portion of the first wiring member and the second base portion of the second wiring substrate are stacked together, and the terminal portion of the first base portion and the terminal portion of the second base portion are disposed in positions not interfering with each other. In the case, since the first base portion and the second base portion are stacked together, the area of the stacked area of the first base portion and the second base portion can be decreased. Accordingly, the second wiring substrate is miniaturized, and therefore the head unit can be miniaturized.

In addition, in the above-described ejecting head unit, it may be configured that the first wiring substrate is formed from a COF substrate, and the second wiring substrate is formed from a flexible printed substrate. In such a case, heat of a driving circuit that is mounted on the COF substrate can be dissipated by the support member.

In addition, the above-described ejecting head unit may be configured to further include a holding member that holds the liquid ejecting head on the side of a bottom face and holds the head substrate on the side of a side face. In such a case, a plurality of the liquid ejecting heads can be held together by the holding member.

According to a second aspect of the invention, there is provided a liquid ejecting apparatus including the above-described liquid ejecting head unit. According to the above-described liquid ejecting apparatus, a miniaturized liquid ejecting apparatus of which costs are reduced can be implemented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

Embodiment 1

Figure 1:
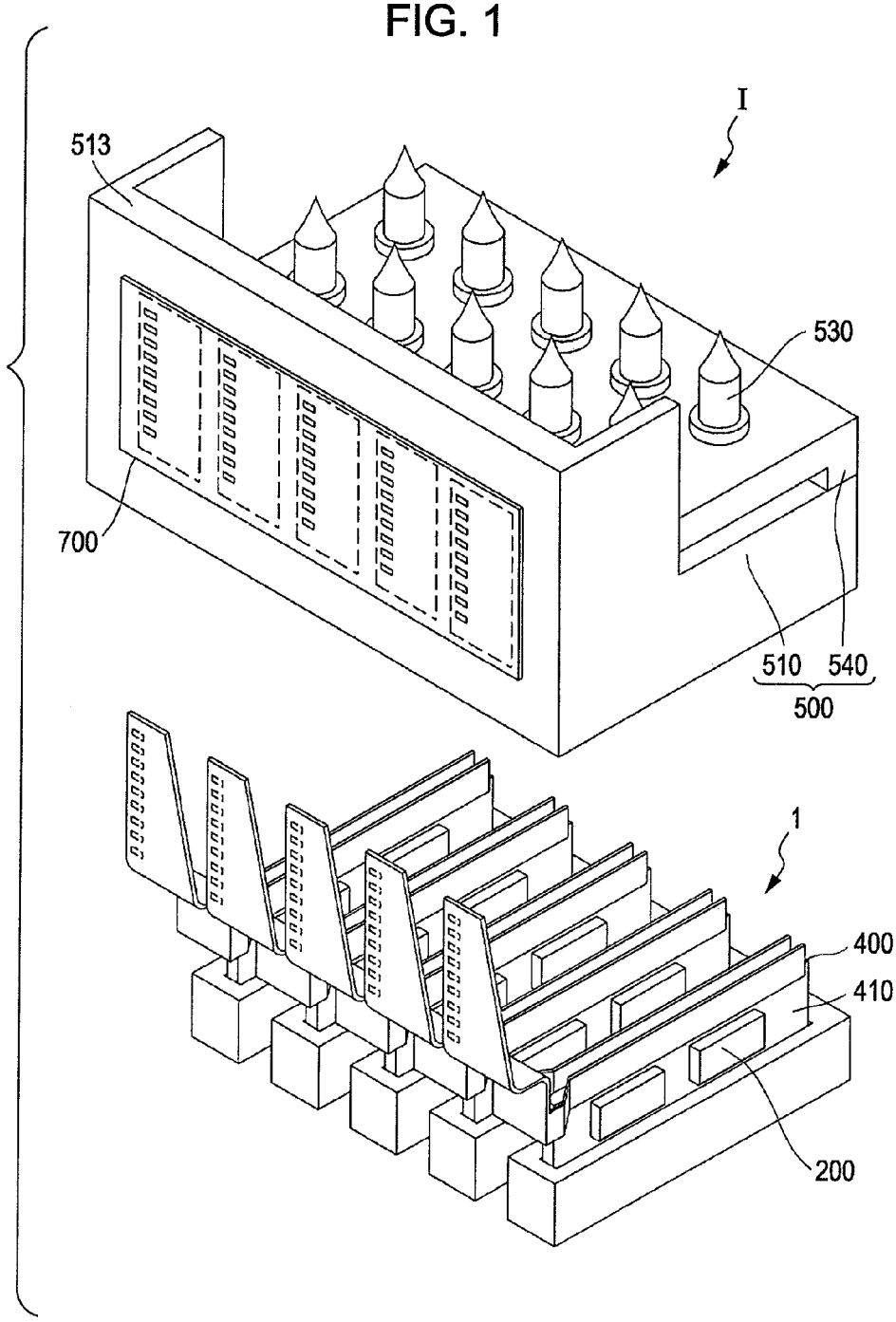
FIG. 1 is a schematic perspective view of a head unit according to Embodiment 1.
Figure 2:
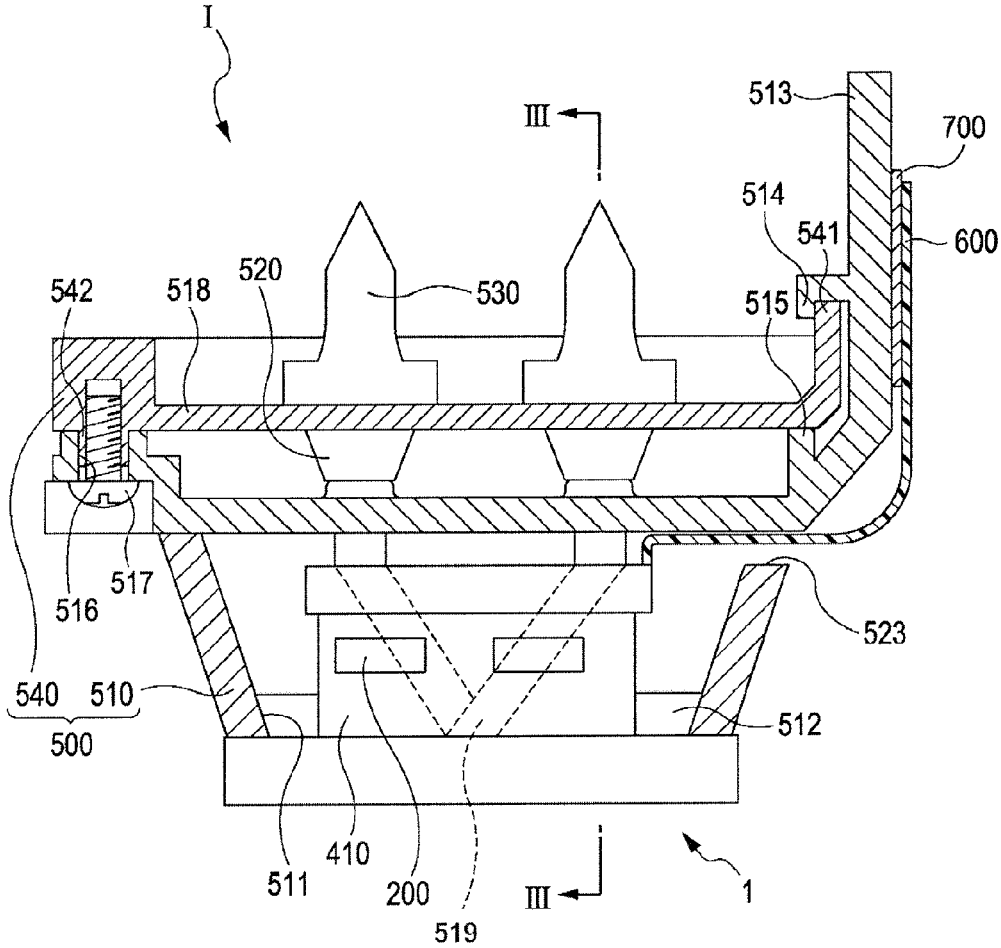
FIG. 2 is a cross-sectional view of a head unit according to Embodiment 1.
Figure 3:
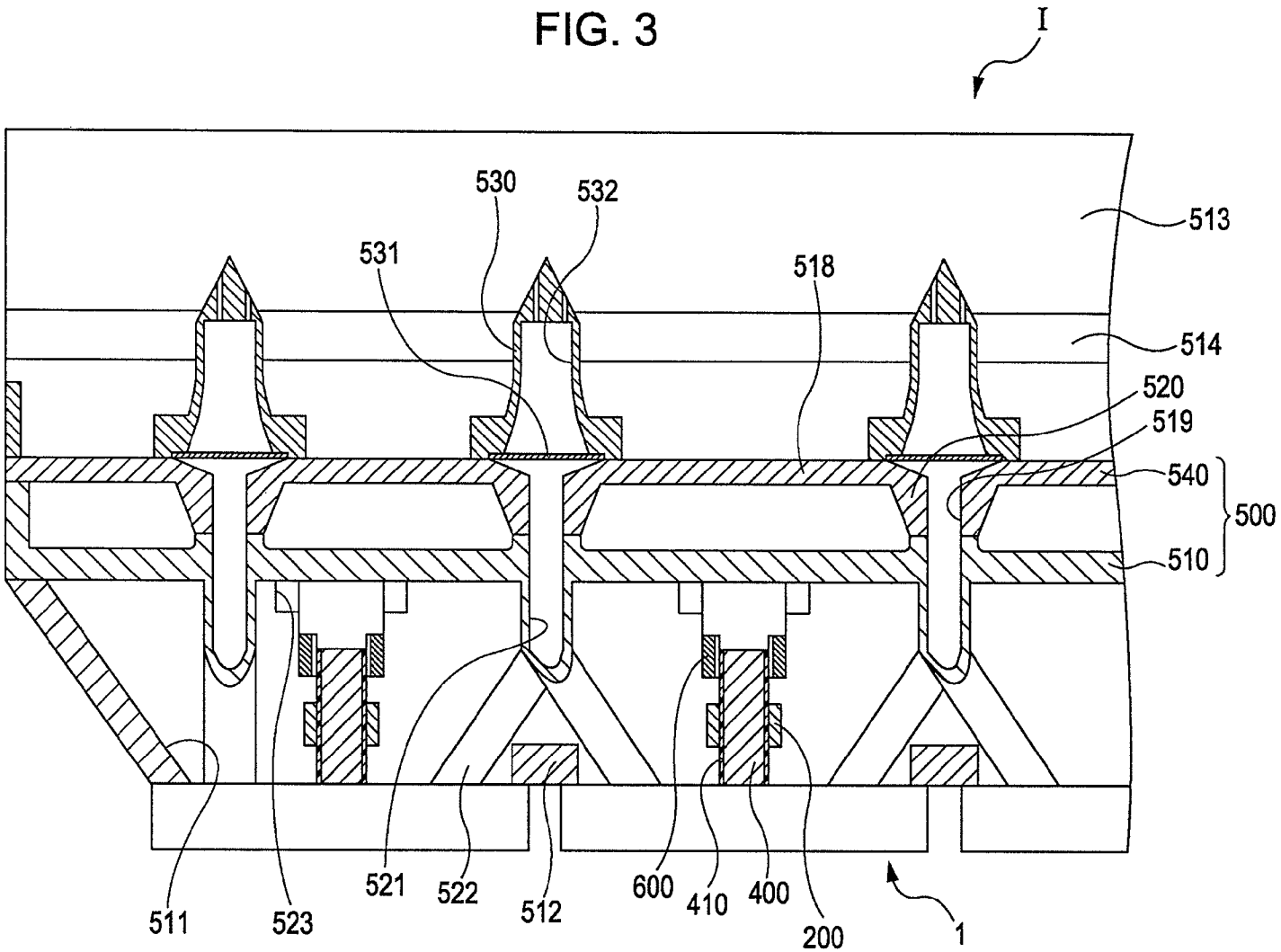
FIG. 3 is a cross-sectional view of a head unit according to Embodiment 1.

FIG. 1 is an exploded perspective view of an ink jet recording head unit as an example of a liquid ejecting head unit according to Embodiment 1 of the invention. FIG. 2 is a cross-sectional view of an ink jet recording head. FIG. 3 is a cross-sectional view taken along line III-III shown in FIG. 2.

As shown in the figure, the ink jet recording head unit I (hereinafter, also referred to as a head unit I) includes a plurality of ink jet recording heads 1 (hereinafter, also referred to as recording heads 1), a holding member 500 that holds the recording heads 1, and a second wiring substrate 600 that electrically connects a head substrate 700 installed to the holding member 500 and the recording heads 1 to each other.

Figure 4:
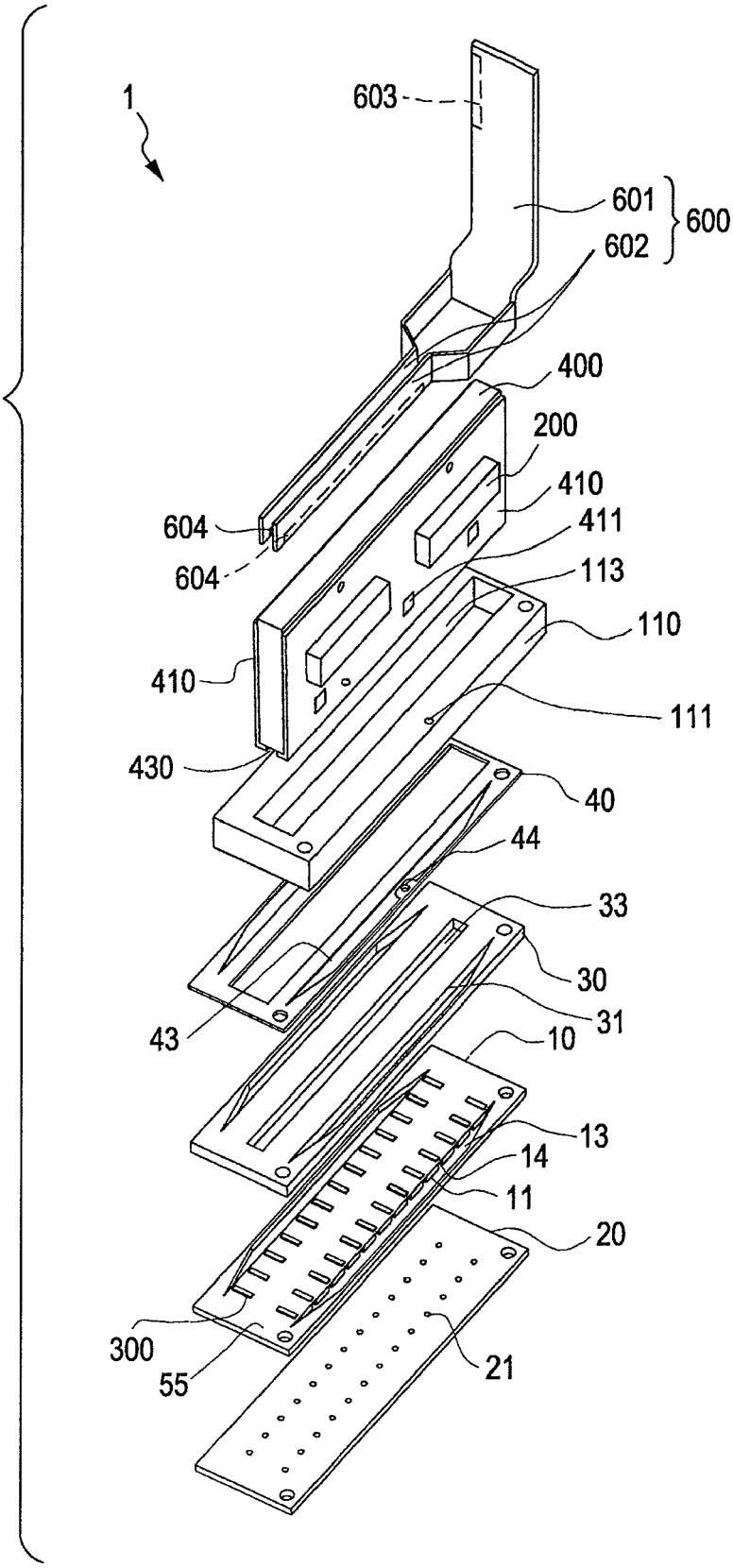
FIG. 4 is an exploded perspective view of a recording head according to Embodiment 1.
Figure 5:
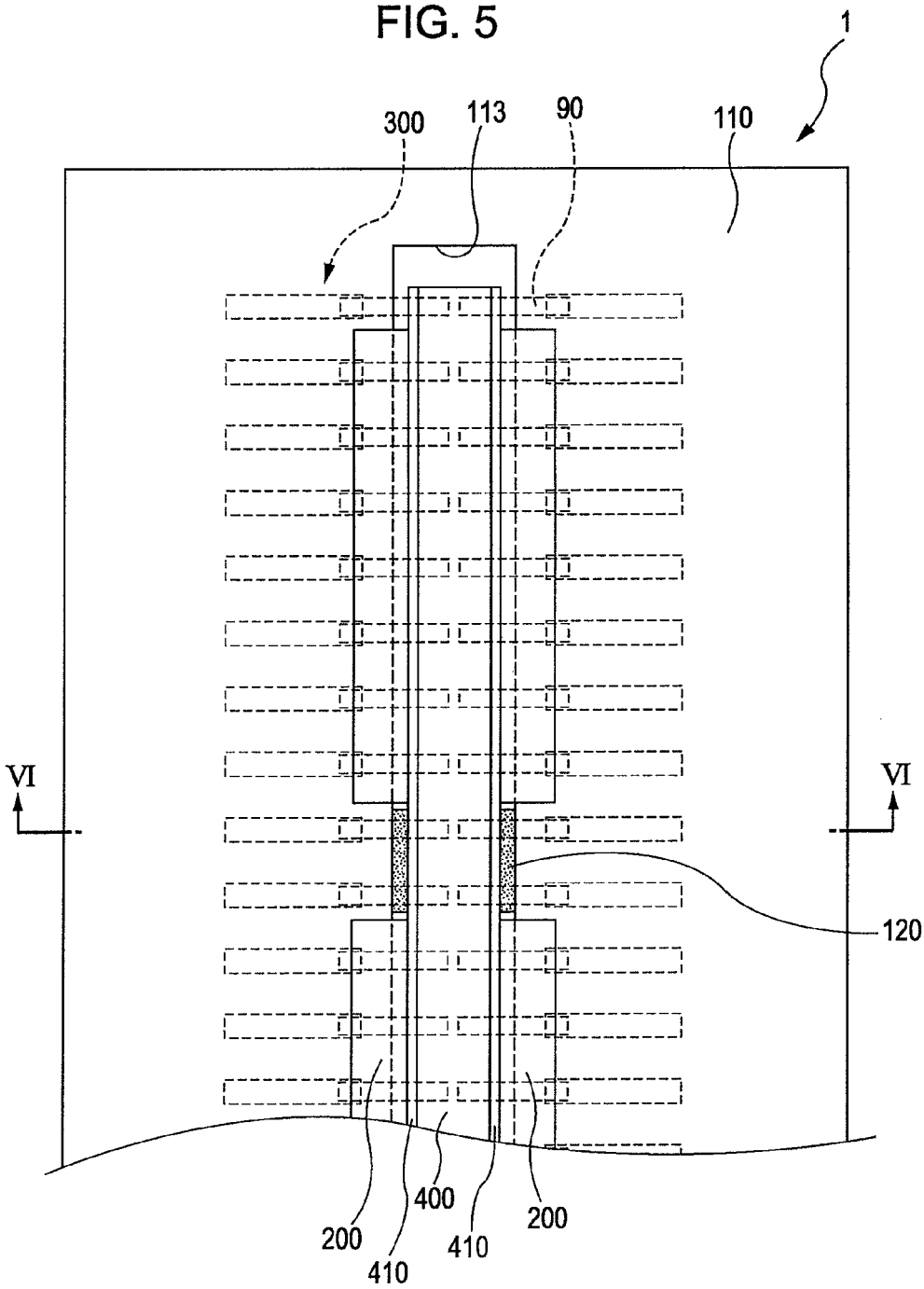
FIG. 5 is a plan view of a recording head according to Embodiment 1.
Figure 6:
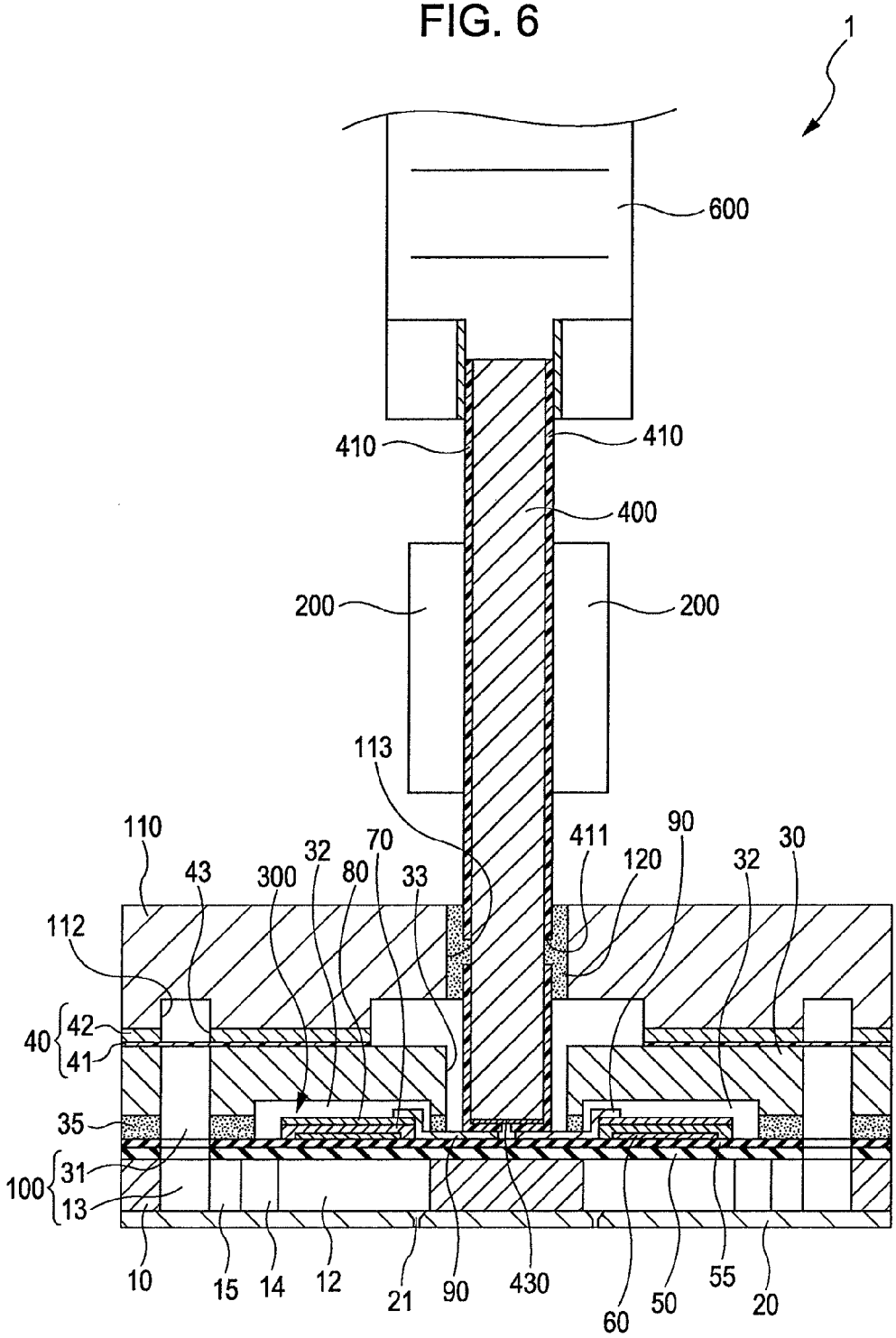
FIG. 6 is a cross-sectional view of a recording head according to Embodiment 1.

First, the recording head 1 will be described in detail with reference to FIGS. 4 to 6. FIG. 4 is an exploded perspective view of a recording head according to Embodiment 1 of the invention. FIG. 5 is a plan view of the recording head, and FIG. 6 is a cross-sectional view taken along line VI-VI shown in FIG. 4.

As shown in the above-described figures, a flow path forming substrate 10 according to this embodiment is formed of a silicon monocrystal substrate having the plane orientation of (110). On one face of the flow path forming substrate 10, an elastic film 50 that is formed from silicon dioxide is formed.

In the flow path forming substrate 10, two rows each formed by arranging a plurality of pressure generating chambers 12 partitioned by a partition wall 11 in parallel in the widthwise direction are arranged. In addition, in an outer area of the pressure generating chambers 12 of each row in the longitudinal direction, a communication portion 13 is formed, and the communication portion 13 and each pressure generating chamber 12 are communicated with each other through an ink supplying path 14 and a communication path 15 that are disposed for each pressure generating chamber 12. The communication portion 13 is communicated with a reservoir portion 31 of a protection substrate 30 to be described later and configures a part of a reservoir 100 that becomes a common ink chamber for each row of the pressure generating chambers 12. The ink supplying path 14 is formed to have a width narrower than that of the pressure generating chamber 12 and maintains flow path resistance of ink flowing into the pressure generating chamber 12 from the communication portion 13 to be constant. In addition, according to this embodiment, the ink supplying path 14 is formed by constricting the width of the flow path from one side. However, the ink supplying path may be formed by constricting the width of the flow path from both sides. In addition, the ink supplying path may be formed by constricting the flow path in the thickness direction, instead of constricting the flow path in widthwise direction. In addition, each communication path 15 is formed by partitioning a space between the ink supplying path 14 and the communication portion 13 by extending the partition walls 11 located on both sides of the pressure generating chambers 12 to the communication portion 13 sides in the widthwise direction. In other words, in the flow path forming substrate 10, the ink supplying path 14 having a cross-sectional area smaller than that of the pressure generating chamber 12 in the widthwise direction and the communication path 15 that is communicated with the ink supplying path 14 and has a cross-sectional area larger than that of the ink supplying path 14 in the widthwise direction are disposed by being partitioned by a plurality of the partition walls 11.

In addition, on the opening face side of the flow path forming substrate 10, a nozzle plate 20, in which nozzle openings 21 that are communicated with areas near end portions of the pressure generating chambers 12 that are located on a side opposite to the ink supplying path 14 is formed, is fixed by using an adhesive agent, a heat-welding film, or the like. In this embodiment, two rows in which the pressure generating chambers 12 are arranged are disposed on the flow path forming substrate 10. Accordingly, in one recording head 1, two nozzle rows in which the nozzle openings 21 are arranged are disposed. The nozzle plate 20, for example, is formed of glass ceramics, a single-crystal silicon substrate, or stainless steel.

On the other hand, on a side of the flow path forming substrate 10 that is located opposite to the opening face, as described above, the elastic film 50 is formed. In addition, an insulation film 55 is formed on the elastic film 50. In addition, on the insulation film 55, a first electrode 60, a piezoelectric body layer 70, and a second electrode 80 are sequentially laminated to be formed so as to configure a piezoelectric element 300 that is a pressure generating element according to this embodiment. Here, the piezoelectric element 300 represents a portion that includes the first electrode 60, the piezoelectric body layer 70, and the second electrode 80. Generally, any one electrode of the piezoelectric element 300 is used as a common electrode, and the other electrode and the piezoelectric body layer 70 are patterned for each pressure generating chamber 12. Here, a portion that is configured by the patterned electrode and the patterned piezoelectric body layer 70 and has piezoelectric distortion by applying a voltage to both electrodes is called as a piezoelectric body active part. In this embodiment, the first electrode 60 located on the flow path forming substrate 10 side is configured as the common electrode of the piezoelectric element 300, and second electrode 80 is configured as an individual electrode of the piezoelectric element 300. However, these may be oppositely configured depending on the situation of the driving circuit and wirings. In addition, here, the piezoelectric element 300 and a vibration plate that is displaced in accordance with driving of the piezoelectric element 300 are collectively referred to as an actuator device. In addition, in the above-described example, the elastic film 50, the insulation film 55, and the first electrode 60 serve as a vibration plate. However, the invention is not limited thereto. For example, a configuration in which only the first electrode 60 serves as a vibration plate without disposing the elastic film 50 and the insulation film 55 may be used. Alternatively, the piezoelectric element 300 may be configured so as to substantially serve as the vibration plate as well.

The piezoelectric body layer 70 is formed of a piezoelectric material, which exhibits electromechanical energy converting reaction occurring on the first electrode 60, and more particularly, a ferroelectric material, which has a perovskite structure, among piezoelectric materials. It is preferable that a crystal film having a perovskite structure is used for the piezoelectric body layer 70. For example, a ferroelectric material such as lead zirconium titanate (PZT), or the ferroelectric material to which metal oxide such as niobium oxide, nickel oxide, or magnesium oxide is added may be appropriately used for the piezoelectric body layer 70.

In addition, to the second electrode 80 that is an individual electrode of the piezoelectric element 300, a lead electrode 90 that extends to an area located on the insulation film 55 and is, for example, formed of gold (Au) is connected. One end portion of the lead electrode 90 is connected to the second electrode 80, and the other end portion of the lead electrode 90 extends to be installed between the rows in which the piezoelectric elements 300 are arranged.

On the flow path forming substrate 10, in which the piezoelectric elements 300 are formed, that is, on the first electrode 60, the insulation film 55, and the lead electrode 90, the protection substrate 30 having the reservoir portion 31 that configures at least a part of the reservoir 100 is bonded through an adhesive agent 35. This reservoir portion 31, according to this embodiment, is formed to extend in the widthwise direction of the pressure generating chamber 12 by perforating the protection substrate 30 in the thickness direction. Thus, as described above, the reservoir portion 31 is communicated with the communication portion 13 of the flow path forming substrate 10 and configures the reservoir 100 that becomes the common ink chamber of the pressure generating chambers 12. In addition, in this embodiment, the communication portion 13 that becomes the reservoir 100 is disposed on the flow path forming substrate 10. However, the invention is not particularly limited thereto. For example, the communication portion 13 of the flow path forming substrate 10 may be divided into a plurality of parts for each pressure generating chamber 12, and only the reservoir portion 31 may be configured as the reservoir. Alternatively, for example, only the pressure generating chamber 12 is disposed on the flow path forming substrate 10, and an ink supplying path 14 that allows the reservoir 100 and each pressure generating chamber 12 to be communicated with each other may be disposed in a member (for example, the elastic film 50, the insulation film 55, or the like) that is interposed between the flow path forming substrate 10 and the protection substrate 30.

In addition, in each area of the protection substrate 30 that faces the piezoelectric elements 300, a piezoelectric element holding portion 32 that is a holding portion having a space sufficient for not blocking the movement of the piezoelectric elements 300 is disposed. The piezoelectric element holding portion 32 is configured to have a space sufficient for not blocking the movement of the piezoelectric elements 300. The space may be sealed or may not be sealed. In addition, according to this embodiment, two rows in which the piezoelectric elements 300 are arranged are disposed, and accordingly, the piezoelectric element holding parts 32 are disposed in correspondence with each arranged row in which the piezoelectric elements 300 are arranged. In other words, in the protection substrate 30, two piezoelectric element holding parts 32 are disposed in the arrangement direction of the rows in which the piezoelectric elements 300 are arranged.

As the protection substrate 30, it is preferable that a material such as a glass material or a ceramic material that approximately has a same coefficient of thermal expansion as that of the flow path forming substrate 10 is used. In this embodiment, a single-crystal silicon substrate that is the same as the material of the flow path forming substrate 10 is used for forming the protection substrate 30.

In addition, in the protection substrate 30, a through hole 33 that is formed by perforating the protection substrate 30 in the thickness direction is disposed. The through hole 33, in this embodiment, is disposed between the two piezoelectric element holding parts 32. In addition, a portion of the lead electrode 90 near an end thereof that is led out from each piezoelectric element 300 is disposed so as to be exposed inside the through hole 33.

A driving circuit 200 that is used for driving the piezoelectric element 300 is mounted in a connection wiring (not shown) of a COF substrate 410 that is a first wiring substrate. Here, although not shown in the figure, the connection wiring is disposed in the COF substrate 410. A lower end portion of the connection wiring is connected to the lead electrode 90, and the COF substrate 410 is set up to be approximately vertical. Thus, the COF substrate 410 is bonded to the side face of a plate-shaped support member 400. In other words, the support member 400 is a rectangular parallelepiped having both side faces to be vertical faces. In addition, the end portion of the connection wiring of the COF substrate 410 that is opposite to the end portion connected to the lead electrode 90 is disposed in the upper end portion (the end portion opposite to the flow path forming substrate 10) of the COF substrate 410 so as to extend in the direction of disposition of the nozzle openings 21 and is connected to the second wiring substrate 600 to be described later in detail. In addition, in this embodiment, the end portion of the connection wiring that is connected to the second wiring substrate 600 is disposed on a face side on which the driving circuit 200 is mounted, that is, a face opposite to the support member 400.

Described in more detail, in the recording head 1 according to this embodiment, two rows in which the pressure generating chambers 12 are arranged are disposed in the flow path forming substrate 10, and accordingly, two rows in which the piezoelectric elements 300 are arranged in the widthwise direction of the pressure generating chamber 12 (the widthwise direction of the piezoelectric element 300) are disposed. In other words, two rows of the pressure generating chambers 12, two rows of the piezoelectric elements 300, and two rows of the lead electrodes 90 are disposed to face one another. To both sides of the support member 400 having a lower portion inserted into the through hole 33, the COF substrates 410 are bonded. Thus, the connection wiring of the lower end portion of each COF substrate 410 is connected to the end portions of the lead electrodes 90 of each row of the piezoelectric elements 300 and the first electrode 60, and The COF substrate 410 is set up to be approximately vertical. According to this embodiment, by disposing one COF substrate 410 on each side face of the support member 400, a total of two COF substrates 410 are disposed in one support member 400.

In addition, when being erected alone, the COF substrate 410 that is a wired substrate having flexibility can be easily bent. Accordingly, by bonding the COF substrate 410 to the support member 400 that is a rigid member serving as a brace member, the COF substrate 410 can be erected by suppressing bending thereof. Alternatively, only the COF substrate 410 may be arranged to erect in a direction perpendicular to the face of the flow path forming substrate 10 on which the piezoelectric elements 300 are arranged without disposing the support member 400. In addition, the COF substrate 410 is configured to be bonded to the side face of the support member 400. However, the configuration is not limited thereto. Thus, for example, the COF substrate 410 may be held to be fallen so as to be hooked with the support member 400.

In addition, as shown in FIG. 6, between the lower end face of the support member 400 and the lower end portion of the COF substrate 410, a buffer member 430 that can be appropriately formed from Teflon (a registered trademark) or the like is disposed. In addition, the lower end portion of the COF substrate 410 and the lead electrode 90 are electrically connected by using conductive particles (for example, those contained in an anisotropic conductive material such as an anisotropic conductive film (ACF) or anisotropic conductive paste (ACP)). In other words, by pressing the support member 400 down, the COF substrate 410 is pressed to the lead electrode 90 side through the lower end face thereof. Accordingly, the predetermined electrical connection between the COF substrate 410 and the lead electrode 90 is made by smashing the conductive particles. At this moment, the buffer member 430 serves to allow the pressure on the COF substrate 410 to be uniform. Here, it is preferable that the lower end face of the support member 400 and the lower end portion of the COF substrate 410 or the lower end face of the support member 400 that is brought into contact with the buffer member 430 is configured to have surface precision within five times the particle diameter of the conductive particle. The reason is that, in such a case, through existence of the buffer member 430 and the lower end portion of the COF substrate 410, the pressure applied to the conductive particles can be uniform, and whereby excellent electrical connection can be acquired by smashing the conductive particles. Here, the connection between the lower end portion of the COF substrate 410 and the lead electrode 90 is not limited to the case where the conductive particles are used. Thus, for example, the lower end portion of the COF substrate 410 and the lead electrode 90 may be connected to each other by melting a metal material such as solder.

In addition, it is preferable that the support member 400 has such thermal conductivity that allows the support member 400 to dissipate heat for having the temperature of the driving circuit 200 to be lower than the junction temperature even for a case where the recording head 1 is used at the maximum warranty temperature. In such a case, even when the driving circuit 200 operates under the most severe load condition, sufficient heat dissipation is exhibited, and accordingly, stable driving of the driving circuit for a long time can be achieved. Accordingly, the support member 400 according to this embodiment is formed from SUS as a material thereof. In such a case, the support member 400 allows heat generated by the driving circuit 200 to be absorbed in ink circulating the inside of the driving circuit 200 through the flow path forming substrate 10. As a result, the heat generated by the driving circuit 200 can be dissipated effectively. Similar effects can be acquired by configuring a distance between the surface of the flow path forming substrate 10 and the driving circuit 200 to be sufficiently short even for a case where a metal material such as SUS is not used. In other words, the distance between the driving circuit 200 and the flow path forming substrate 10 may configured to be a distance in which heat is dissipated such that the temperature of the driving circuit 200 is lower than the junction temperature even for a case where the recording head 1 is used at the maximum warranty temperature.

In addition, it is preferable that the support member 400 is formed of a material that has a linear expansion coefficient equivalent to that of a head case 110 that is a holding member to be described later in detail. For example, stainless steel, silicon, or the like may be used as the material for the support member 400.

In addition, as shown in FIG. 6, on the protection substrate 30, a compliance substrate 40 that is formed of a sealing film 41 and a fixed plate 42 is bonded. Here, the sealing film 41 is formed of a material having low rigidity and flexibility (for example, a polyphenylene sulfide (PPS) film). One side of the reservoir portion 31 is sealed by the sealing film 41. In addition, the fixed plate 42 is formed of a hard material (for example, stainless steel (SUS) or the like) such as metal. An area of the fixed plate 42 that faces the reservoir 100 becomes an opening portion 43 acquired by completely eliminating a portion of the fixed plate 42 in the thickness direction, and accordingly, one side of the reservoir 100 is sealed only by the sealing film 41 having flexibility.

In addition, on the compliance substrate 40, the head case 110, which is a holding member, is disposed. In the head case 110, an ink introduction path 111 that is communicated with the ink introduction opening 44 and supplies ink to the reservoir 100 from a storage unit such as a cartridge is disposed (see FIG. 4). In addition, in an area of the head case 110 that faces the opening portion 43, a concave portion 112 (see FIG. 6) is formed such that bending deformation of the opening portion 43 is made appropriately. In addition, in the head case 110, a wiring member holding hole 113 that is communicated with the through hole 33 that is formed in the protection substrate 30 is disposed. The lower end portion of the COF substrate 410 is connected to the lead electrode 90 in a state in which the COF substrate 410 and the support member 400 pass through the inside of the wiring member holding hole 113. In addition, the COF substrate 410 and the support member 400 that pass through the wiring member holding hole 113 of the head case 110 are bonded to the head case 110 through the adhesive agent 120. Here, the head case 110 and the COF substrate 410 may be bonded to each other through the adhesive agent 120. However, by directly bonding the head case 110 and the support member 400 to each other, the support member 400 can be held in the head case 110 more assuredly. In other words, by bonding the head case 110 and the support member 400 as rigid bodies, a state in which the COF substrate 410 and the lead electrode 90 are assuredly connected to each other can be maintained. Accordingly, any inconvenience of separation of connection between the COF substrate 410 and the lead electrode 90 so as to be disconnected from each other or the like can be prevented. In this embodiment, the holding holes 411 that are formed in the thickness direction at the predetermined intervals are disposed along the direction of installation of the lead electrode 90 are arranged in the COF substrate 410, and the head case 110 and the support member 400 are bonded together through the holding holes 411 by using the adhesive agent 120. Here, in a case where the head case 110 and the support member 400 are directly bonded to each other, it is preferable that the head case 110 and the support member 400 are formed of materials having the equivalent linear expansion coefficient. In addition, according to this embodiment, the head case 110 and the support member 400 are formed of stainless steel. Accordingly, when the recording head 1 is expanded or contracted due to heat, bending or destruction due to a difference of the linear expansion coefficients of the head case 110 and the support member 400 can be prevented. When the head case 110 and the support member 400 are formed of materials having different linear expansion coefficients, the support member 400 presses the flow path forming substrate 10, and whereby a crack may be generated in the flow path forming substrate 10. In addition, it is preferable that the head case 110 and the support member 400 are formed of materials having an approximately same linear expansion coefficient as that of the protection substrate 30 to which these members are fixed.

In such a recording head 1, the COF substrate 410 is disposed so as to protrude to a side opposite to the ink ejecting face on which the nozzle openings 21 are opened.

The head unit I according to this embodiment, as shown in FIGS. 1 to 3, includes a holding member 500 on the COF substrate 410 side of the recording head 1.

The holding member 500 includes a supply needle holder 540 in which a base member 510 and a plurality of supply needles 530 are disposed.

In the base member 510, a wiring substrate inserting hole 511 is disposed on the bottom side, and a plurality of recording heads 1 is held on the bottom in which the wiring substrate inserting hole 511 is opened. The base member 510 holds the plurality of recording heads 1 in the disposition direction of rows of the nozzle row. In this embodiment, the base member 510 holds five recording heads 1.

In addition, the wiring substrate inserting hole 511 has such a size that the COF substrate 410 and the support member 400 can be inserted therein without allowing the recording head 1 to pass through it. In addition, the bottom for which the wiring substrate inserting hole 511 of the base member 510 is opened is bonded to the head case 110 of the recording head 1 through an adhesive agent. The wiring substrate inserting hole 511 may be configured to be independent for each recording head 1 or may be configured so as to continuously extend for a plurality of recording heads 1. However, since a plurality of recording heads 1 is held in the base member 510, bridge portions 512 that block each space between adjacent recording heads 1 are disposed in the wiring substrate inserting hole 511 so as not to allow ink to penetrate to the inside from each space between adjacent recording heads 1. In order to configure the wiring substrate inserting holes 511 to be independent for the plurality of recording heads 1, the bridge portions 512 are formed to be in the same depth as the wiring substrate inserting hole 511. On the other hand, in order to configure the wiring substrate inserting hole 511 to be common to the plurality of recording heads 1 and to communicate with one another, the bridge portions 512 are arranged only on the recording head 1 side so as to partition a space for communication above the bridge portions 512.

In addition, on a first side (a side intersecting the side to which the supply needle holder is fixed) of the base member 510, a wall portion 513 that is erected in the same direction (the direction of erection of the COF substrate 410) as the insertion direction of the wiring substrate inserting hole 511 is disposed. The wall portion 513 is disposed to extend to the plurality of recording heads 1. In other words, the wall portion 513 is disposed such that the disposition direction of the plurality of recording heads 1 is the direction of the face of the wall portion 513. In addition, on the outer side of the wall portion 513, the head substrate 700 is fixed.

On the head substrate 700 that is held by the base member 510, electronic components for various driving signals are mounted, and a driving signal is supplied to the recording head 1 through the second wiring substrate 600 that is connected to the end portion of the recording head 1. In addition, a connector not shown in the figure is disposed on the head substrate 700. External wirings such as control cables from control devices are electrically connected to the head substrate 700 through the connector.

In addition, as shown in FIG. 2, on a side of the partition wall 513 to which the supply needle holder 540 is fixed, a hook-shaped engaging claw 514 that is opened to the side to which the supply needle holder 540 is brought into contact with and a protrusion portion 515 that protrudes towards the engaging claw 514 side, which is disposed in a position facing the engaging claw 514, are arranged. In addition, near the end portion of the base member 510 that is located opposite to the wall portion 513, a supply needle holder fixing hole 516 that is formed in the thickness direction is disposed. The supply needle holder 540 is fixed to the base member 510 by engaging one end side of the supply needle holder 540 with a space between the engaging claw 514 and the protrusion portion 515 and fixing the other end portion of the supply needle holder 540 by using a fixing screw 517 that is inserted through the supply needle holder fixing hole 516.

Here, as shown in FIG. 3, the supply needle holder 540 has a cartridge installing portion 518, to which an ink cartridge serving as a storage unit storing ink therein is installed, on a side opposite to the side fixed to the base member 510, that is, the top surface in the figure.

In addition, on the bottom face of the supply needle holder 540, a tube-shaped first flow path forming portion 520, in which a plurality of first supply paths 519 having one end opened to the cartridge installing portion 518 and the other end opened to the base member 510 side is formed, protrudes.

As shown in FIG. 2, on one end side of the supply needle holder 540, an engaged claw 541 having the front end protruding upward is disposed. By engaging the engaged claw 541 with a space between the engaging claw 514 of the base member 510 and the protrusion portion 515, one end portion of the supply needle holder 540 is fixed to the base member 510. In addition, in the end portion of supply needle holder 540 that is located opposite to the engaged claw 541, a fixing portion 542, inserted into the supply needle holder fixing hole 516 of the base member 510, with which the fixing screw 517 is engaged is disposed. The position of the supply needle holder 540 is determined by inserting the fixing portion 542 into the supply needle holder fixing hole 516 of the base member 510 in a state in which the engaged claw 541 is engaged with the space between the engaging claw 514 of the base member 510 and the protrusion portion 515. Then, the supply needle holder 540 is fixed to the base member 510 by inserting the fixing screw 517 into the supply needle holder fixing hole 516 of the base member 510 from the side opposite to the supply needle holder 540 and screwing the fixing screw 517 to the fixing portion 542 of the supply needle holder 540.

As shown in FIG. 3, to the top surface side of the supply needle holder 540, that is, an opening portion of the first supply path 519 of the cartridge installing portion 518, a plurality of supply needles 530 that is inserted into the ink cartridges is fixed through a filter 531 that is used for eliminating air bubbles or foreign materials inside the ink.

Each of the supply needles 530 has a through hole 532 that is communicated with the first supply path 519. By inserting the supply needle 530 into the ink cartridge, ink inside the ink cartridge is supplied to the first supply path 519 of the supply needle holder 540 through the through hole 532 of the supply needle 530.

On the other hand, inside the wiring substrate inserting hole 511 of the base member 510, a tube-shaped second flow path forming portion 522, in which the second supply path 521 having one end that is communicated with the ink introduction path 111 of the recording head 1 and the other end that is communicated with each first supply path 519 is arranged, is disposed. In other words, the ink supplied from the through hole 532 of the supply needle 530 is supplied to the recording head 1 through the first supply path 519 of the supply needle holder 540 and the second supply path 521 of the holding member 500. In addition, although not particularly shown in the figure, in areas for connecting the flow paths of each member, that is, an area between the supply needle holder 540 and the first holding member 500 and the like, circular packing formed from elastomer, rubber, or the like is disposed. By this packing, ink passing through the first supply path 519 and the second supply path 521 allows the first supply path 519 and the second supply path 521 to communicate with each other without incurring any leakage of the ink to the outside thereof.

On the other hand, as shown in FIG. 3, the COF substrate 410 of the recording head 1 and the support member 400 are inserted into the wiring substrate inserting hole 511 of the base member 510, as described above. In addition, inside the wiring substrate inserting hole 511 of the base member 510, the second wiring substrate 600 is disposed.

The second wiring substrate 600, for example, is formed of a wiring substrate such as a flexible printed circuit (FPC) substrate having flexibility, and, as shown in FIGS. 4 and 6, one second wiring substrate 600 is connected to two COF substrates 410 of the recording head 1. As shown in FIGS. 1 and 3, since five recording heads 1 are disposed in the head unit I of this embodiment, there are five second wiring substrates 600 each disposed for each record head 1.

Figure 7A:
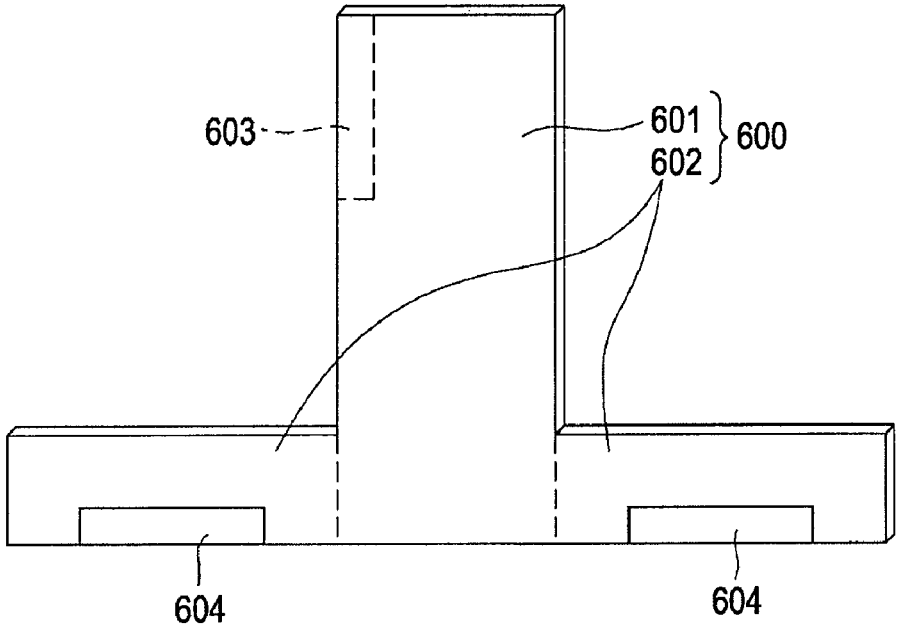
FIGS. 7A and 7B are perspective views showing a second wiring substrate according to Embodiment 1.
Figure 7B:
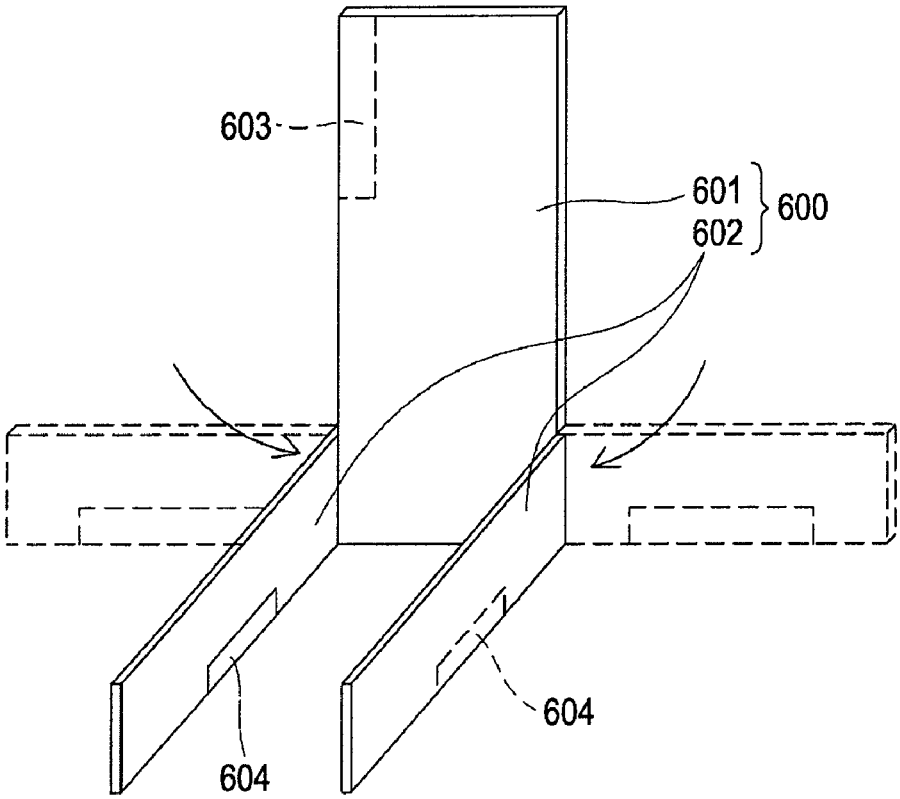

In particular, as shown in FIG. 7B, the second wiring substrate 600 includes a base portion 601 disposed to extend in one direction and two leg portions 602 that are disposed on one end portion side of the base portion 601 and are disposed to extend in a direction intersecting the extending direction of the base portion 601.

On the other end portion side of the base portion 601 that is the side opposite to one end portion in which the leg portions 602 are disposed, a group 603 of a plurality of input terminal portions connected to the head substrate 700 is disposed.

In addition, two leg portions 602 are disposed in the same direction by bending the two leg portions 602 that are disposed in the same face direction as that of the base portion 601 so as to face each other. On faces, which face each other, located on the lower end portion (the lower side in FIGS. 7A and 7B) sides of the leg portions 602, groups 604 of pluralities of output terminal portions that are connected to the connection wiring of the COF substrate 410 of the ink jet recording head 1 are disposed. The two groups 604 of the output terminal portions are electrically connected to the group 603 of the input terminal portions of the base portion 601 through wirings (not shown) passing through the leg portions 602 and the base portion 601. In other words, in the second wiring substrate 600, the input terminal portion and the output terminal portions are disposed as terminal portions.

The groups 604 of the output terminal portions of two leg portions 602 of the second wiring substrate 600 are connected to the connection writings of two COF substrates 410 of the ink jet recording head 1. The two COF substrates 410 are aggregated by one second wiring substrate 600 and are connected to the head substrate 700.

In other words, two COF substrates 410 of the ink jet recording head 1 can be simultaneously connected to the head substrate 700 by using one second wiring substrate 600. In particular, in the ink jet recording head 1 of this embodiment, two COF substrates 410 are disposed on both side faces located in different positions of the support member 400. Accordingly, one row of the connection wirings (terminal portions) connected to the second wiring substrate 600 of the COF substrate 410 is disposed on each of both side faces of the support member 400 (not shown). It is difficult to simultaneously connect the terminal portions of the connection wirings of two rows to the head substrate 700. However, as in this embodiment, by using the second wiring substrate 600 having bent leg portions 602, two COF substrates 410 that are disposed in different positions can be simultaneously connected to one face of the head substrate 700 through the second wiring substrate 600. In other words, the two COF substrates 410 can be simultaneously connected to the head substrate 700 by one connection of the second wiring substrate 600. Accordingly, the second wiring substrate 600 does not need to be disposed for each COF substrate 410, and the number of components can be decreased. In addition, the number of connection processes can be decreased. Therefore, the manufacturing cost can be reduced.

In addition, in this embodiment, the ink jet recording heads 1 are aligned, and the COF substrates 410 are aligned toward the alignment direction of the ink jet recording heads 1. Accordingly, by disposing the head substrate 700 to a side face in which the alignment direction of the COF substrate 410 of the holding member 500 becomes the face direction, a plurality of the second wiring substrates 600 can be connected on a same face. In other words, a face on which the connection wirings connected to the second wiring substrate 600 of the COF substrate 410 are disposed and a face on which the group 603 of input terminal portions connected to the head substrate 700 of the second wiring substrate 600 are disposed so as to intersect each other. Even in such a disposition, by using the above-described second wiring substrate 600, the COF substrate 410 and the head substrate 700 can be connected to each other in an easy manner.

In addition, the head substrate 700 may be disposed to be independent for each second wiring substrate 600 or may be disposed to be common to a plurality of the second wiring substrates 600. However, configuring the head substrate 700 to be common to the plurality of the second wiring substrates 600, the number of components can be decreased. In addition, in such a case, connection spots between the head substrate 700 and control unit or the like can be decreased, and the head substrate 700 can be miniaturized, whereby the head unit I can be miniaturized.

In addition, the second wiring substrate 600 can be formed in an easy manner by bending a film-shaped wiring member. In particular, first, as shown in FIG. 7A, a film-shaped wiring member that is formed such that the base portion 601 and two leg portions 602 form a shape of the letter "T" on a same plane is prepared. Next, as shown in FIG. 7B, two leg portions 602 are bent in a direction intersecting a face on which the group 603 of input terminal portions of the base portion 601 is disposed. At this moment, the two leg portions 602 are bent in a same direction. Accordingly, the second wiring substrate 600 in which the two leg portions 602 bent in the shape of the letter "L" with respect to the base portion 601 are disposed can be formed in an easy manner.

In addition, when the wirings (the group 603 of the input terminal portions and the groups 604 of the output terminal portions) are disposed in only one face side of the second wiring substrate 600 formed by bending the leg portions 602 only, the groups 604 of the output terminal portions can be disposed on faces on which the two leg portions 602 face each other. However, the group 603 of the input terminal portions is disposed on the side of a face of the base portion 601 that faces toward the leg portions 602. Accordingly, as shown in FIGS. 7A and 7B, it is preferable that the group 603 of the input terminal portions and the groups 604 of the output terminal portions are disposed on different faces of the film-shaped wiring member in advance, and the group 603 of the input terminal portions and the groups 604 of the output terminal portions are connected to each other through a contact hole or the like.

In a case where the groups 604 of the output terminal portions are disposed on the faces of the two leg portions 602 facing each other, and the group 603 of the input terminal portions 603 is disposed on the face of the base portion 601 that faces toward the leg portions 602, the direction of the head substrate 700 may be adjusted.

Alternatively, the groups 604 of the output terminal portions may be disposed on faces opposite to the faces of the two leg portions 602 that face each other, that is, the outer sides. In such a case, it is preferable that the connection between the COF substrate 410 and the second wiring substrate 600 is reversed.

Figure 8A:
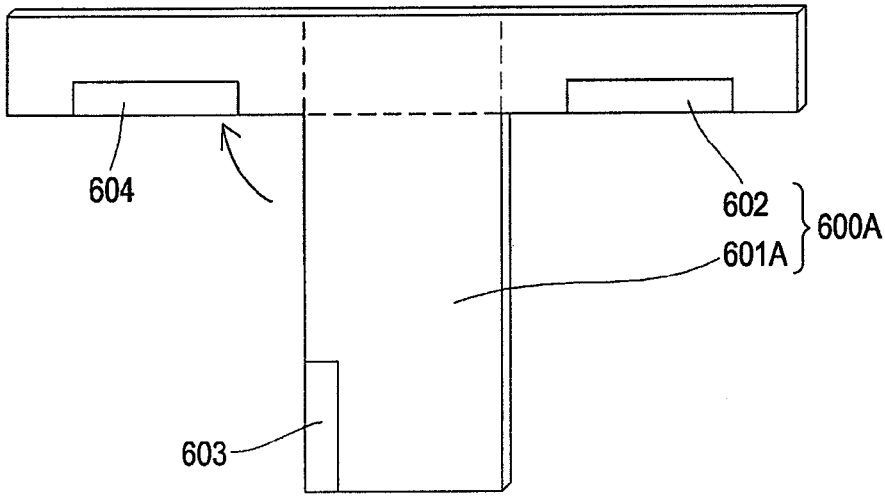
FIGS. 8A and 8B are perspective views of a second wiring substrate according to a modified example of Embodiment 1.
Figure 8B:
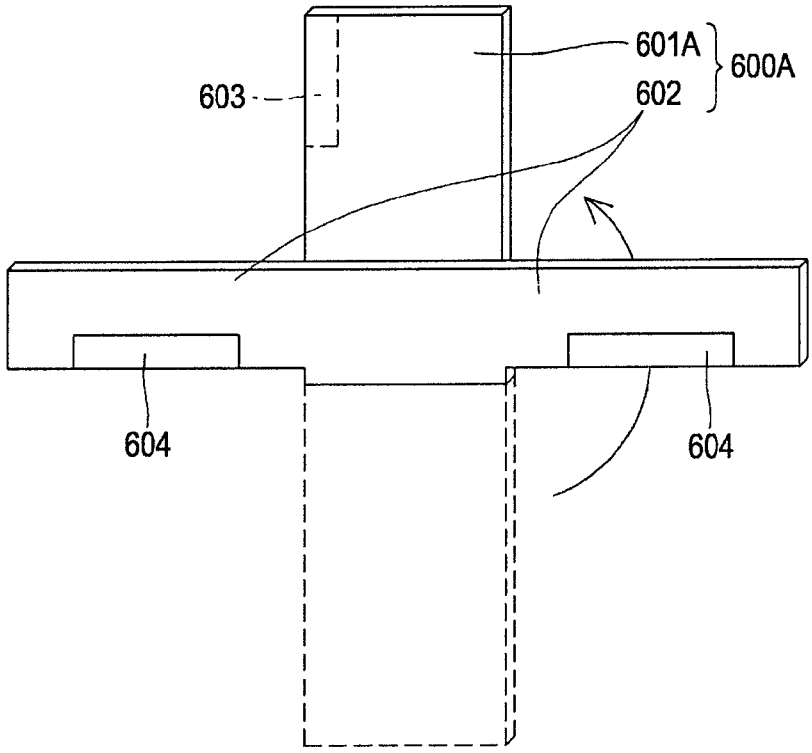
Figure 9:
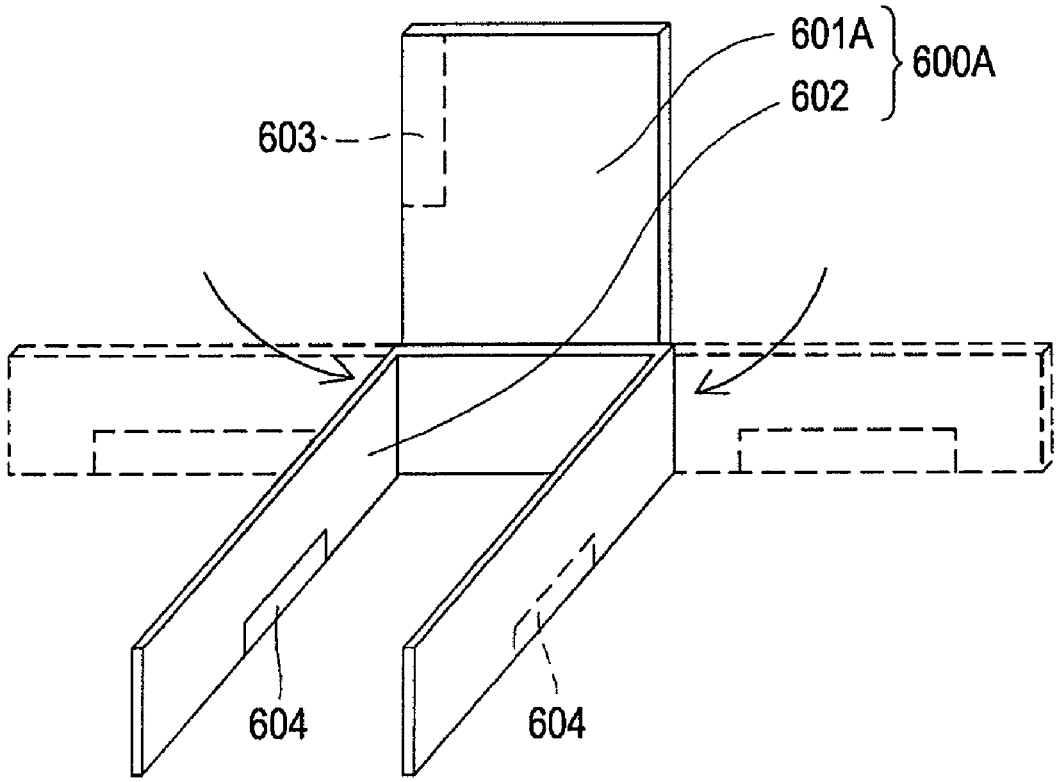
FIG. 9 is a perspective view of a second wiring substrate according to a modified example of Embodiment 1.

In addition, the second wiring substrate 600 is not limited to those described above. For example, as the second wiring substrate 600A, as shown in FIG. 9, a second wiring substrate 600A in which the base portion 601A turned over with the leg portions 602 used as the center may be used. In particular, first, as shown in FIG. 8A, a film-shaped wiring member having the shape of the letter "T" in which the group 603 of input terminal portions and the groups 604 of output terminal portions are disposed on a same face side is prepared. Next, as shown in FIG. 8B, the base portion 601A is turned over with the leg portions 602 used as the center. Then, as shown in FIG. 9, by bending the leg portions 602, the second wiring substrate 600A can be formed. In the second wiring substrate 600A formed as described above, as shown in FIG. 8A, even in a case where the wirings (the groups 603 and 604 of the input terminal portions and the output terminal portions) are disposed only on one face, finally, as shown in FIG. 9, the groups 604 of the output terminals are disposed on faces of the two leg portions 602 facing each other, and the group 603 of the input terminal portions is disposed on a face of the base portion 601A that is opposite to a face of the base portion 601A facing toward the leg portions 602, without disposing the wirings on both faces. Accordingly, the manufacturing cost of the second wiring substrate 600A can be reduced, compared to a second wiring substrate 600 having the wires disposed on both faces thereof. In addition, the second wiring substrate 600A can be connected to the head substrate 700 or the COF substrate 410 in a direction visually recognizable from the outside.

Figure 10A:
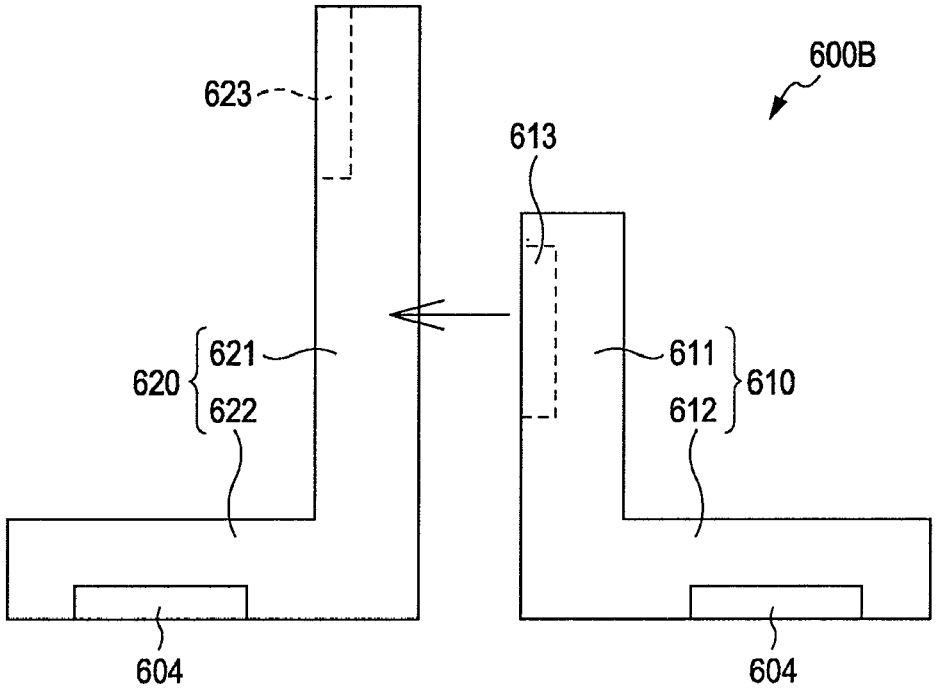
FIGS. 10A and 10B are side views of a second wiring substrate according to a modified example of Embodiment 1.
Figure 10B:
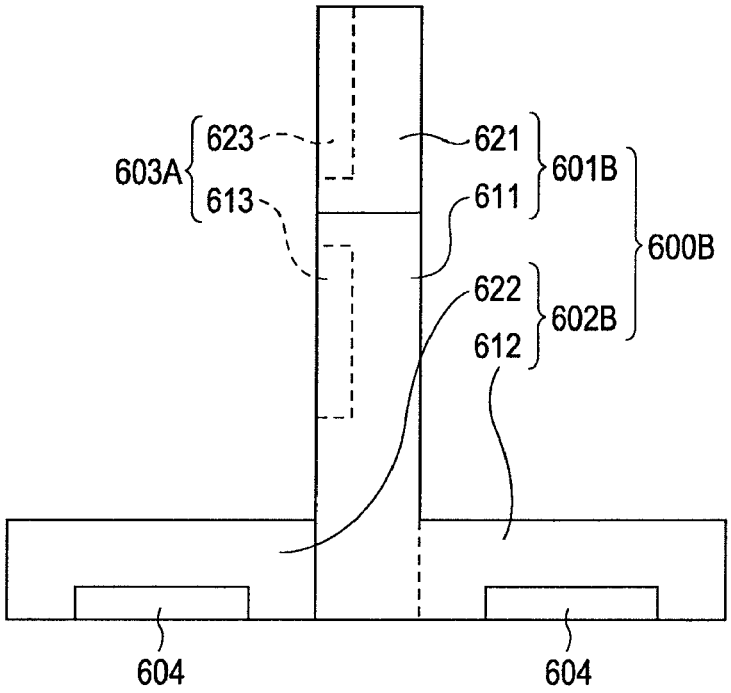

Furthermore, the second wiring substrate 600 is not limited to one that is formed by using one film-shaped wiring member. Thus, the second wiring substrate 600 may be formed by staking a plurality of film-shaped wiring members. Such an example is shown in FIGS. 10A and 10B. As shown in FIGS. 10A and 10B, the second wiring substrate 600B is configured by arranging a first wiring member 610 having the shape of the letter "L" and a second wiring member 620 having the shape of the letter "L" and stacking the first wiring member 610 and the second wiring member 620 together.

In particular, the first wiring member 610 includes a first base portion 611 in which the group 613 of input terminals portions to be connected to the head substrate 700 is disposed and a first leg portion 612 that is to be connected to the COF substrate 410 disposed on one side of the support member 400 and is disposed to extend in a direction intersecting a face of the first base portion 611 in which the group 613 of input terminal portions is disposed.

In addition, the second wiring member 620 includes a second base portion 621 in which the group 623 of input terminals portions to be connected to the head substrate 700 is disposed and a second leg portion 622 that is to be connected to the COF substrate 410 disposed on one side of the support member 400 and is disposed to extend in a direction intersecting a face of the second base portion 621 in which the group 623 of input terminal portions is disposed.

Then, by stacking the first base portion 611 of the first wiring member 610 and the second base portion 621 of the second wiring member 620, the second wiring substrate 600B is configured. In addition, the group 613 of input terminal portions of the first base portion 611 and the group 623 of input terminals of the second base portion 621 are disposed in positions not interfering with each other.

In particular, the second wiring substrate 600B is formed by the process shown in FIGS. 10A and 10B. In other words, as shown in FIG. 10A, a film-shaped wiring member having the shape of the letter "L" in a same plane and a film-shaped wiring member having the shape of a reversed letter "L" bent in the reverse direction in a same plane are prepared. Then, by overlapping the straight line portions (the first base portion 611 and the second base portion 621), the second wiring substrate 600B that is formed of a letter "T"-shaped film material having the base portion 601B configured by the first base portion 611 and the second base portion 621 and the leg portion 602B configured by the first leg portion 612 and the second leg portion 622 is formed. Thereafter, in the same manner as shown in the above-described FIG. 7B, by bending the leg portion 602B, that is, the first leg portion 612 and the second leg portion 622, the second wiring substrate 600B is formed. In addition, the second wiring substrate 600B shown in FIGS. 10A and 10B is connected to two COF substrates 410 that are supported by the support member 400 as the first and second first wiring substrates.

Since the second wiring substrate 600B is formed by stacking the first base portion 611 and the second base portion 621, a wiring disposed in the first base portion 611 and a wiring disposed in the second base portion 621 are disposed in a stacked state. Accordingly, the widths of the first base portion 611 and the second base portion 621 in the face direction can be decreased. Therefore, the second wiring substrate 600B can be miniaturized, whereby the head unit I can be miniaturized.

In addition, the method of connecting the COF substrate 410 and the second wiring substrate 600 (hereafter, it includes the above-described second wiring substrates 600A and 600B) together is not particularly limited. For example, the COF substrate 410 and the second wiring substrate 600 may be connected by melting metal such as solder or using an anisotropic conductive material such as an anisotropic conductive film (ACF) or anisotropic conductive paste (ACP).

In addition, in a side face of the holding member 500 that is located on a face side on which the head substrate 700 is held, a plurality of slits 523 is disposed in correspondence with each second wiring substrate 600. Thus, the second wiring substrate 600 of each recording head 1 is disposed on the outer periphery side of the holding member 500 through the slit 523. In addition, the base portion 601 of the second wiring substrate 600 that is disposed to extend externally through the slit 523 is bent along the wall portion 513 of the holding member 500, and the group 603 of input terminal portions 603 thereof is electrically connected to the head substrate 700. In addition, as the method of connecting the head substrate 700 and the second wiring substrate 600, similarly to the above-described method of connecting the COF substrate 410 and the second wiring substrate 600, a method melting metal such as solder or a method using an anisotropic conductive material, or the like may be used.

In the head unit I having the above-described configuration, ink from the ink cartridge is inserted into the reservoir 100 through the through hole 532, the first supply path 519, the second supply path 521, the ink introduction path 111, and the ink introduction opening 44, and the inside of the flow path from the reservoir 100 to the nozzle opening 21 is filled with the ink. Thereafter, by applying voltages to the piezoelectric elements 300 corresponding to the pressure generating chambers 12 in accordance with a recording signal supplied from the head substrate 700 through the second wiring substrate 600 and the COF substrate 410, the vibration plate 23 is flexibly transformed together with the piezoelectric element 300. Accordingly, the pressure inside each pressure generating chamber 12 is increased, and ink droplets are ejected from each nozzle opening 21.

Other Embodiments

As above, an embodiment of the invention has been described. However, the basic configuration according to an embodiment of the invention is not limited thereto. For example, in the above-described Embodiment 1, as the second wiring substrates 600 to 600B, flexible printed substrates have been exemplified. However, only bending areas of the second wiring substrates 600 to 600B may be configured to have flexibility. Thus, for example, a rigid-flexible substrate may be used. In other words, for example, a rigid-flexible substrate having a configuration in which the head substrate 700 side and the COF substrate 410 side are rigid substrates, and the two rigid substrates are connected with a flexible substrate may be used. However, as in the above-described Embodiment 1, by using the flexible printed substrates as the second substrates 600 to 600B, troublesome assembly or connection is not needed, whereby the manufacturing costs can be decreased.

In addition, for example, in the above-described Embodiment 1, the COF substrates 410 are disposed on both sides of the support member 400. However, two or more COF substrates 410 may be configured to be disposed on each side.

In addition, in the above-described Embodiment 1, one COF substrate 410 is disposed on each of both sides of the support member 400. However, the invention is not particularly limited thereto. For example, one continuous COF substrate may be used as the COF substrate 410 disposed on both sides. Furthermore, it may be configured that the driving circuit 200 is disposed in a different position, and a first wiring substrate in which any circuit is not mounted other than the COF substrate may be used.

In addition, in the above-described Embodiment 1, two rows in which the pressure generating chambers 12 are disposed in parallel are arranged on the flow path forming substrate 10. However, in such a case, the number of the rows is not particularly limited. Thus, there may be one, three or more rows. When a plurality of rows is disposed, at least two rows forming one set are disposed to face each other.

In addition, in the above-described Embodiment 1, although an actuator device having a thin-film type piezoelectric element 300 has been described as the pressure generating element that generates a pressure change in the pressure generating chamber 12, however, the invention is not limited thereto. For example, an actuator device of a thick film type that is formed by using a method of attaching a green sheet or the like, an actuator device of a vertical-vibration type that laminates a piezoelectric material and an electrode forming material alternately and expands or contracts the materials in the axis direction, or the like may be used. In addition, a device in which a heating element is disposed inside the pressure generating chamber as the pressure generating element and ink droplets are discharged from a nozzle opening due to bubbles that are generated by heat generation of the heating element, so-called an electrostatic actuator that generates static electricity between a vibration plate and an electrode and discharges ink droplets from a nozzle opening by transforming the vibration plate based on an electrostatic force, or the like may be used.

Figure 11:
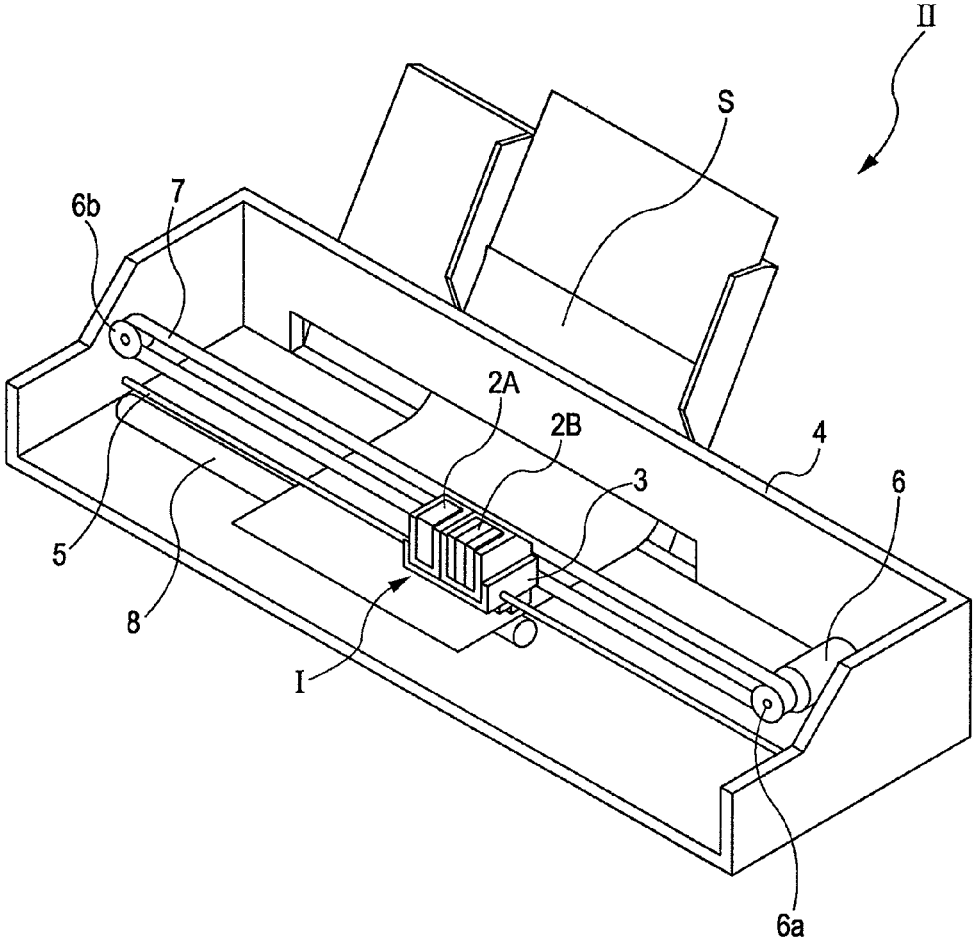
FIG. 11 is a schematic diagram showing an ink jet recording apparatus according to an embodiment of the invention.

In addition, the head unit I of the above-described embodiment is mounted to an ink jet recording apparatus. FIG. 11 is a schematic diagram showing an example of the ink jet recording apparatus. As shown in the figure, the head unit I of the above-described Embodiment 1 is configured such that cartridges 2A and 2B configuring the ink supplying unit can be detachably attached thereto. In addition, a carriage 3 on which the head unit I is mounted is disposed to a carriage shaft 5, which is installed to an apparatus main body 4, so as to be movable in the shaft direction. For example, this head unit I is configured to eject a black ink composition and a color ink composition.

As a driving force of the driving motor 6 is transferred to the carriage 3 through a plurality of gears and a timing belt 7 that are not shown in the figure, the carriage 3 on which the head unit I is mounted moves along the carriage shaft 5. On the other hand, in the apparatus main body 4, a platen 8 is disposed along the carriage shaft 5, and a recording sheet S as a recording medium such as a paper sheet that is fed by a paper feed roller not shown in the figure or the like is wound around the platen 8 so as to be transported.

In addition, in the above-described ink jet recording apparatus II, the head unit I is mounted in the carriage 3 so as to move in the main scanning direction has been described as an example. However, the invention is not limited thereto. Thus, the invention can be applied to so-called a line-type recording apparatus in which the head unit I is fixed, and printing is performed by only moving a recording sheet S such as a paper sheet in the sub scanning direction.

In addition, in the above-described embodiment, the ink jet recording head as an example of a liquid ejecting head has been described. However, the invention is for the overall liquid ejecting heads in a broad meaning. Thus, the invention may be applied to a liquid ejecting head that ejects liquid other than ink, as well. As other liquid ejecting heads, for example, there are various recording heads that are used for an image recording apparatus such as a printer, a color material ejecting head that is used for manufacturing a color filter of a liquid crystal display or the like, an electrode material ejecting head that is used for forming an electrode of an organic EL display, an FED (field emission display), or the like, and a bioorganic material ejecting head that is used for manufacturing a bio chip. In addition, as an example of the liquid ejecting apparatus, the ink jet recording apparatus II has been described. However, the invention may be applied to a liquid ejecting apparatus that uses the above-described liquid ejecting heads other than the ink jet head.

What is claimed is:

1. A liquid ejecting head unit that includes a liquid ejecting head ejecting liquid by driving a pressure generating element, the liquid ejecting head unit comprising:

the liquid ejecting head that includes a plurality of first wiring substrates each having a connection wiring electrically connected to the pressure generating element and a support member that supports at least two first wiring substrates of the plurality in different positions;

a second wiring substrate that is commonly connected to the connection wirings of the plurality of the first wiring substrates electrically; and a head substrate to which the second wiring substrate is electrically connected, wherein a terminal portion connected to the head substrate is aligned on one face side of the second wiring substrate, wherein a face of the first wiring substrate, in which the connection wiring connected to the second wiring substrate is disposed, and a face of the second wiring substrate, in which the terminal portion connected to the head substrate is disposed, are arranged so as to intersect each other.

2. The liquid ejecting head unit according to claim 1, wherein the liquid ejecting head is a plurality of liquid ejecting heads, and wherein a plurality of the second wiring substrates is electrically connected to one face side of the common head substrate.

3. The liquid ejecting head unit according to claim 1, wherein the second wiring substrate includes:

a base portion in which the terminal portion connected to the head substrate is disposed; and at least two leg portions that are disposed to extend in a direction intersecting a face of the base portion in which the terminal portion of the base portion is disposed and are connected to the connection wiring of the first wiring substrate.

4. The liquid ejecting head unit according to claim 1, wherein the second wiring substrate includes:

a first wiring member that includes a first base portion in which the terminal portion connected to the head substrate is disposed, and a first leg portion that is connected to the first wiring substrate and is disposed in a direction intersecting a face of the first base portion in which the terminal portion is disposed; and a second wiring member that includes a second base portion in which the terminal portion connected to the head substrate is disposed and a second leg portion that is disposed to extend in a direction intersecting a face of the second base portion on which the terminal portion is disposed by connecting the support member to a second first wiring substrate disposed in a different position, wherein the first base portion of the first wiring member and the second base portion of the second wiring substrate are stacked together, and wherein the terminal portion of the first base portion and the terminal portion of the second base portion are disposed in positions not interfering with each other.

5. The liquid ejecting head unit according to claim 1, wherein the first wiring substrate is formed from a wired substrate having flexibility, and the second wiring substrate is formed from a flexible printed substrate.

6. The liquid ejecting head unit according to claim 1, further comprising a holding member that holds the liquid ejecting head on the side of a bottom face and holds the head substrate on the side of a side face.

7. A liquid ejecting apparatus comprising: the liquid ejecting head unit according to claim 1.

* * * * *